US009119442B2

(12) United States Patent
Oberhofer

(10) Patent No.: US 9,119,442 B2
(45) Date of Patent: Sep. 1, 2015

(54) SHOE WITH A WIDTH MEASURING DEVICE MEASURING MEANS

(71) Applicant: Clevermess UG, Titting (DE)

(72) Inventor: Nicole Oberhofer, Titting (DE)

(73) Assignee: Clevermess GmbH, Titting (DE)

( * ) Notice: Subject to any disclaimer, the term of this patent is extended or adjusted under 35 U.S.C. 154(b) by 154 days.

(21) Appl. No.: 14/034,801

(22) Filed: Sep. 24, 2013

(65) Prior Publication Data

US 2014/0096406 A1 Apr. 10, 2014

(30) Foreign Application Priority Data

Sep. 24, 2012 (DE) ..... 10 2012 109 000

(51) Int. Cl.
*A43D 1/06* (2006.01)
*A43D 1/02* (2006.01)

(52) U.S. Cl.
CPC . *A43D 1/027* (2013.01); *A43D 1/06* (2013.01)

(58) Field of Classification Search
CPC ..... A43D 1/027; A43D 1/06
USPC ..... 33/3 A, 3 B, 3 C, 3 R, 512
See application file for complete search history.

(56) References Cited

U.S. PATENT DOCUMENTS

| | | | | |
|---|---|---|---|---|
| 2,326,820 | A | 8/1943 | Bliss | |
| 2,793,439 | A | 5/1957 | Simpson | |
| 2,835,043 | A * | 5/1958 | Woodman et al. | 33/3 C |
| 3,359,670 | A * | 12/1967 | Pyc et al. | 40/479 |
| 3,368,281 | A * | 2/1968 | Mogens | 33/3 A |
| 5,128,880 | A * | 7/1992 | White | 33/512 |
| 2005/0168756 | A1 * | 8/2005 | Massen | 356/601 |
| 2007/0266581 | A1 * | 11/2007 | Long et al. | 33/3 A |
| 2009/0205213 | A1 * | 8/2009 | Goonetilleke et al. | 33/3 R |
| 2015/0059214 | A1 * | 3/2015 | Donovan et al. | 33/3 A |

FOREIGN PATENT DOCUMENTS

| | | | |
|---|---|---|---|
| AT | 501 906 | A4 | 12/2006 |
| DE | 606 590 | | 11/1934 |
| DE | 202 15 090 | U1 | 1/2003 |
| DE | 10 2004 045 858 | A1 | 4/2006 |
| DE | 20 2011 103 464 | U1 | 10/2011 |
| JP | 3798802 | B1 | 7/2006 |
| NL | 8900820 | | 11/1990 |

OTHER PUBLICATIONS

EP Search Report, Jan. 22, 2014.
German Search Report, Jul. 12, 2013.

* cited by examiner

*Primary Examiner* — G. Bradley Bennett
(74) *Attorney, Agent, or Firm* — Dority & Manning, P.A.

(57) ABSTRACT

A shoe-measuring gadget for determining the accuracy of fit of shoes has a foot length-measuring device for determining the foot length of a foot positioned in the shoe-measuring gadget and an inner shoe length-measuring device for determining the spatial length remaining between the longest toe of the foot and the inner shoe wall opposite this toe. The gadget can be used for determining the accuracy of fit after the foot measurement determination in the shoe. The shoe-measuring gadget has a width-measuring device designed in such a way that it is capable of recording the foot width of the foot positioned in the shoe-measuring gadget and, the inner shoe width in the shoe-measuring gadget inserted in the shoe.

17 Claims, 4 Drawing Sheets

SHOE WITH A WIDTH MEASURING DEVICE MEASURING MEANS

FIELD OF THE INVENTION

This invention relates to a shoe-measuring gadget for determining the accuracy of fit of shoes by comparing foot measurements with inner shoe measurements. It comprises a foot length measuring device for determining the length of a foot positioned inside a shoe-measuring gadget and an inner shoe length measuring device for determining the spatial length remaining between the longest toe of the foot and the inner shoe wall opposite this toe. The shoe-measuring gadget for determining accuracy of fit after recording the foot measurement can be used in the shoe intended for this purpose.

BACKGROUND

Especially with regard to children's shoes, there is a considerable risk that the feet of a toddler will deform if he wears the wrong size of children's shoe, thereby leading to possible permanent posture injury. In view of this, the main problem is that shoes of various manufacturers can have different inner shoe measurements in spite of indicating the same shoe size.

Moreover, errors are often made while children's feet are being measured because an accurate measurement can only be properly made when the foot is being strained. Another problem is that shoes expand after being worn a while and this changes their inner measurements. Furthermore, a child's foot measurements change a great deal, especially during growth spurts. For these reasons, it is essential for the healthy and normal development of children's feet that the shoes currently being worn and the actual foot size are measured again on a regular basis for comparison purposes.

However, wearing the wrong shoe size is not only detrimental to children, but to adults as well. In fact, many foot diseases are associated with wearing shoes that are too narrow, and this affects one's well-being for a long time.

The measuring gadgets for the inner shoe known to date merely consider a fixed growth space of 12 mm. However, these gadgets are very cumbersome and can only determine exact measurements unreliably and inaccurately.

A precision instrument for measuring foot length and the inner shoe is known from DE 20 2011 103 464 U1. It comprises a basic part and a movable measuring gadget, as well as a likewise movable precision measuring instrument located in the front part of the measuring gadget. This very handy gadget records first of all the length of a foot that is under strain, positioned inside the shoe-measuring gadget. Afterwards, the gadget is inserted in a shoe to be measured. The precision measuring instrument arranged in the front part of the measuring gadget determines the remaining spatial length between the longest toe of the foot and the inner shoe wall in front of this toe. The gadget has the advantage of being very small and handy—and can therefore be conveniently taken along when buying shoes. In addition, it allows the measurement of shoes at home. Furthermore, the remaining foot-moving space can be measured very reliably. The disadvantage, however, is that this gadget does not measure the width, so it is possible for someone to wear a shoe that fits very well longitudinally but is too narrow or wide. As a result of this, posture problems and foot diseases can occur, in addition to affecting well-being for a long time.

SUMMARY OF THE INVENTION

A task of this invention is therefore to create a shoe-measuring gadget to allow someone to measure the accuracy of fit of a shoe and its width. Additional objects and advantages of the invention will be set forth in part in the following description, or may be obvious from the description, or may be learned through practice of the invention.

According to the invention, the shoe-measuring gadget for determining the accuracy of fit of shoes has a foot length measuring device for measuring the length of a foot positioned inside a shoe-measuring gadget, particularly by comparing foot measurements with inner shoe measurements. Furthermore, the shoe-measuring gadget comprises an inner shoe length measuring device for determining the remaining spatial length between the longest toe of the foot and the inner shoe wall opposite this toe. To determine the accuracy of fit, the shoe-measuring gadget has been designed for use in the shoe intended for this purpose after foot measurements have been recorded. The shoe-measuring gadget has a width-measuring device designed in such a way that it is capable of measuring the foot width (at least in some areas) of the foot positioned inside the shoe-measuring gadget and the inner shoe width (at least in some areas) when the shoe-measuring gadget has been inserted in the shoe. By comparing the measured foot width with the actual inner shoe width, a user can easily estimate the shoe's accuracy of fit. As a result of this, the wearing of a shoe that is too tight or wide is advantageously prevented, as are also associated diseases and a worsening of well-being. The width-measuring device can measure not only the foot and inner shoe width, but also the entire length of the foot or shoe chosen for this.

According to the invention, the width-measuring device has been designed in such a way that it is capable of measuring the remaining spatial width between foot and opposite inner shoe wall. This can be accomplished, for example, by subtracting the measured foot width from the measured inner shoe width. Alternatively, the remaining spatial width between the foot and the opposite inner shoe wall can also be determined directly with a correspondingly designed width measurement device. In this case, the two remaining spatial widths are preferably determined (i.e. between the foot's inner side and the opposite inner shoe wall as well as the foot's outer side and the opposite inner shoe wall) and added, so that the entire remaining spatial width is indicated to the user. Since the width-measuring device automatically determines the remaining spatial width, errors can be prevented when the user intends to estimate the width's accuracy of fit. Furthermore, this simplifies and speeds up the determination of the width's accuracy of fit. Preferably, the width-measuring device includes a calculator that calculates the remaining spatial width.

It is advantageous for the width-measuring device to have at least one width measurement sensor movable in transversal direction so foot width and/or inner shoe width can be very easily and economically measured. Preferably, the width-measuring device has been designed to be movable with respect to the foot length measurement device. Additionally or alternatively, it is advantageous when the inner shoe length measurement device has a length measurement sensor movable in the longitudinal direction of the shoe measuring gadget, especially relative to the foot length measurement device. Even in this case, the remaining spatial length can be measured very easily and economically by means of the movable length measurement sensor. Alternatively or additionally, the width-measuring device and/or the inner shoe length measurement device can have an optical—particularly laser-based—and/or acoustic distance-measuring system for measuring the free spaces between foot and inner shoe wall. This allows measurement accuracy to be improved.

To prevent measuring errors and also to improve the handling of the shoe-measuring gadget, it is advantageous when the length- and/or width-measurement sensor is spring-loaded outwards in the direction of the inner shoe wall chosen for this or inwards in the direction of the foot chosen for this. Advantageously, the length- or width-measurement sensor is therefore automatically pressed against the foot placed in the device with a defined pressing force. Alternatively or additionally, the length- and/or width-measurement sensor is automatically pushed into the free space until it presses against the opposite inner shoe wall with a corresponding pressing force. Free spaces between the length- and/or width-measurement sensor and the foot or inner shoe wall chosen for this can thus be prevented. Consequently, measuring accuracy and reliability can be improved with a spring-loaded length- and/or width-measurement sensor.

To ensure that the measurement result is not falsified after determining a foot measurement or an inner shoe measurement when the shoe-measuring gadget is subsequently moved—particularly when the shoe-measuring gadget is inserted into or removed from the shoe chosen for this —, it is advantageous for the foot length-, inner shoe length- and/or width-measurement gadget to have a locking element that detachably holds this measuring gadget in a set measuring position, especially its length- and/or width measurement sensor. Consequently, a movably designed means of the foot length-, inner shoe length- and/or width-measurement gadget can be fixed in place with this locking element after the foot or shoe has been measured.

A constructively easy and economical implementation of the locking element is made possible if its design includes a lock-in position, so that the foot length-, inner shoe length- and/or width-measurement gadget can be discretely adjusted in steps and held in a set position with a defined force.

To improve measuring accuracy, it is advantageous for the width-measurement sensor to have a stop in its free end area so it can rest on the foot and/or inner shoe side.

It is advantageous for the width-measurement sensor to have, in its free end area, an insertion aid extending in the longitudinal direction of the shoe-measuring gadget towards a toe stop for easier insertion into the shoe and/or an insertion aid extending in the direction of a heel stop for easier removal from the shoe.

It is also advantageous when the toe stop and/or heel stop are detachably designed to facilitate the insertion and/or removal of the shoe-measuring gadget into or from the shoe.

The shoe-measuring gadget can be designed in an especially compact and handy way when the stop is executed so it is movable with regard to the free end of the width-measurement sensor so that it can be changed from a first flat position close to the foot sole to a second raised position close to the foot flank for measuring foot width. Thus, to determine foot width in a foot positioned in the shoe-measuring gadget, the stop is changed from the first position to the second position, especially by turning, folding or displacing it. Moreover, measurement accuracy can therefore be improved when determining foot width because the stop comes to a stop on the widest spot of the foot. This would not be the case in a stop without height adjustment because the foot has a smaller width in the area of its sole than in an area of the foot flank raised for this purpose.

Measurement accuracy can be further improved when the contour of the stop is adapted to largely recreate a foot flank—especially the inner or outer side of the foot. Thus, the stop comes to rest in a very flush way on the foot and this eliminates free spaces between the stop and the foot to be measured.

It is advantageous for the width-measuring device to have two width-measurement sensors that can be moved coaxially towards one another. Thus, the remaining spatial width can be determined in both foot flanks or in the inner shoe walls opposite them. As a result of this, the measurement of the foot and/or shoe width can be speeded up or made more precise.

It is also advantageous if both width-measurement sensors that face in opposite directions to one another are spring-loaded, so when a foot is positioned in the shoe-measuring gadget, each one of the two width-measurement sensors presses on the foot from each side of it with a defined pressing force. Alternatively or additionally, the two width-measurement sensors can be spring-loaded in opposite directions in such a way that they are pressed outwards. In this case, when the shoe-measuring gadget is inserted into the shoe, the width-measurement sensors are automatically pressed against the inner shoe walls with a defined pressing force, and this can improve the reliability and accuracy of the measurement.

It is likewise advantageous for both width-measurement sensors to be movably coupled to one another in such a way that their two free ends come closer to one another or distance themselves when one of the two width-measurement sensors are moved, particularly symmetrically. This can facilitate handling, as only one of the two width-measurement sensors must be moved so both can come to a rest on the inner shoe side or the respective foot flank.

In an advantageous further development of the invention, the width-measuring device for measuring the widest spot of the foot and/or shoe relative to the foot length-measuring device is arranged in the area of the ball of the foot and/or shoe chosen for this. This makes it possible to very likely rule out an excessively narrow or wide shoe because most problems occur in this area of the foot.

It is advantageous for the width-measuring device to be designed so it can be displaced in the longitudinal direction of the shoe-measuring gadget, particularly on the foot length-measuring device. This design allows the width-measuring device to be displaced on the widest spot of the shoe depending on its individual length, for example. Alternatively or additionally, however, additional measurement spots can be the heel or toe area, for example, by simply displacing the width-measuring device to this area.

So the shoe-measuring gadget can be inserted into a shoe without a problem, it is advantageous if the width-measuring device has detachable stops. It is especially advantageous for the width-measuring device to have a largely U-shaped clamping element so it can be fastened to the area of the free ends of the width-measurement sensors for determining the foot width of the foot positioned in the shoe-measuring gadget, especially in a way allowing the stops to be pressed against the foot flanks with a defined force. In this case, the stops are executed in the area of the free ends of the clamping element. To measure the inner shoe width, the clamping element can be removed later so the shoe-measuring gadget can be easily inserted into the shoe. The clamping element is preferably made from an elastic material, especially plastic or spring steel, so its free ends can exert a certain pressing force on the foot flanks. The opening of the clamping element is preferably a little bit smaller than the average width of a foot so it must be bent up somewhat at first in order to be placed above the foot on the corresponding free ends of the width-measuring device.

It is advantageous if the width of the clamping element is executed so it can be adjusted and/or locked in place, so that it can be placed on the foot to be measured with its stops when foot width is being measured. It is also advantageous if the calculator initially determines the foot width above the two width-measurement sensors in the positioned foot, particularly when the two width-measurement sensors are pressed from their widest position to a narrower position and/or are later essentially not moved any longer for a certain time period. Alternatively or additionally to not moving them, a start operating element—especially a button—can be pressed. In this case, the length-measuring sensor is preferably pressed fully for a certain initial time period, especially for at least 2 seconds.

It is advantageous if the calculator, in the state where the shoe is positioned, determines the shoe width through the two width-measurement sensors at a second point in time, particularly when the two width-measurement sensors have been pressed from their widest position to a narrower position and/or are essentially no longer moved later for a certain time period and/or a start operating element, especially a button, is pressed. With regard to the latter, the length-measuring sensor is fully pressed for a second certain time period, particularly for at least 4 seconds.

It is advantageous for the shoe-measuring gadget to have an extension so its length can be adjusted from the size of a children's foot to that of an adult foot.

It is also advantageous if the extension, in the detachable heel stop area, can be fastened to a first structural part of the shoe-measuring gadget (and be removed from it) in the same connecting area.

So the foot width and/or inner shoe width can be determined in various places in the longitudinal direction of the shoe-measuring gadget, it is advantageous if at least two width-measuring devices are arranged separated from one another in the longitudinal direction of the shoe-measuring gadget. The width-measuring devices can—at least partially—be displaced in the longitudinal direction and/or fixed in place on the shoe-measuring gadget.

For an easy handling of the shoe-measuring gadget, it is advantageous if the width-measuring device has a gauge, especially a scale or display, so that the foot width, the inner shoe width, one of the two remaining spatial widths and/or the sum of these two remaining spatial widths can be indicated.

It is advantageous if the shoe-measuring gadget includes a calculator capable of recording a first position and a second position changed with regard to the previous one of the two width-measuring sensors, of measuring the width of a foot by means of the first position of the two width-measuring sensors, of measuring the width of the shoe by means of the second position of the two width-measuring sensors and/or of the difference between these two from the measured width of the foot and the shoe. The calculator preferably indicates the calculated difference on a display.

BRIEF DESCRIPTION OF THE DRAWINGS

Further advantages of the invention are described in the following embodiments, which show.

DETAILED DESCRIPTION

Figure 1:
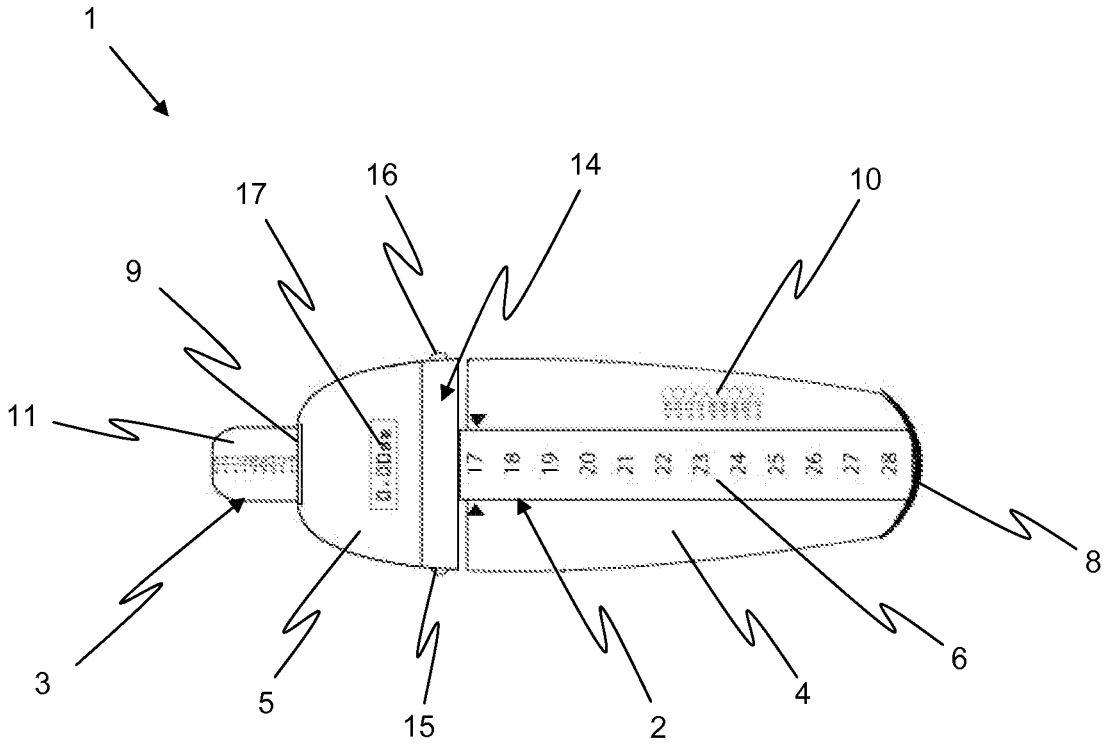
FIG. 1 is a top view of the shoe-measuring gadget.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 3:
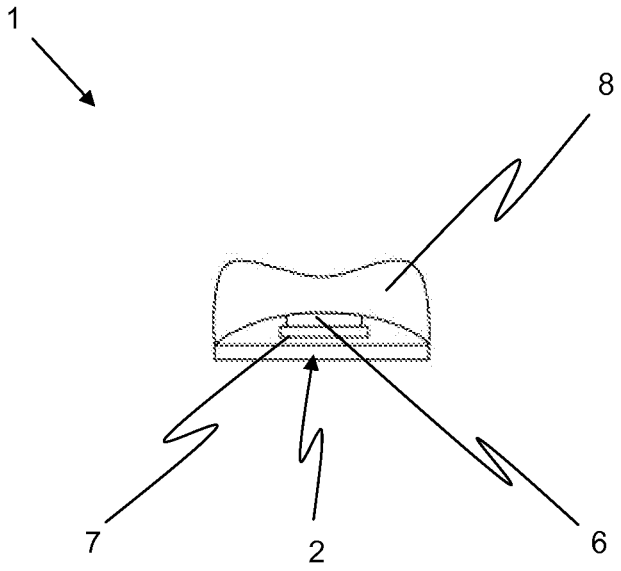
FIG. 3 is a back view of the shoe-measuring gadget.

FIG. 1 shows an embodiment of a shoe-measuring gadget 1 by which the accuracy of fit of shoes can be determined. To do this, the shoe-measuring gadget 1 is designed in a way that allows foot measurements and inner shoe measurements to be determined and compared to one another. The shoe-measuring gadget 1 comprises a foot length-measuring device 2 and an inner shoe length-measuring device 3. The foot length-measuring device 2 comprises a first structural part 4 and a second structural part 5, designed so they can be displaced to each other in the longitudinal direction of the shoe-measuring gadget 1. To accomplish this, the second structural part 5 has a guiding rail 6 in the front side facing the first structural part 4 that is form-fittingly guided in a guiding groove 7 extending in longitudinal direction of the shoe-measuring gadget 1 (cf. FIG. 3).

To determine foot length, the foot length-measuring device 2 has a heel stop 8 and a toe stop 9. The heel stop 8 is executed on the first structural part 4 and the toe stop 9 on the second structural part 5. To indicate the shoe length's accuracy of fit, the shoe-measuring gadget 1 has a first gage 10. The gage 10 is executed as an LED display and may be subdivided into the three sections of "too big", "fits" and "too small". The first gage 10 has a scale in the corresponding sections with additional, more detailed classifications.

Figure 2:
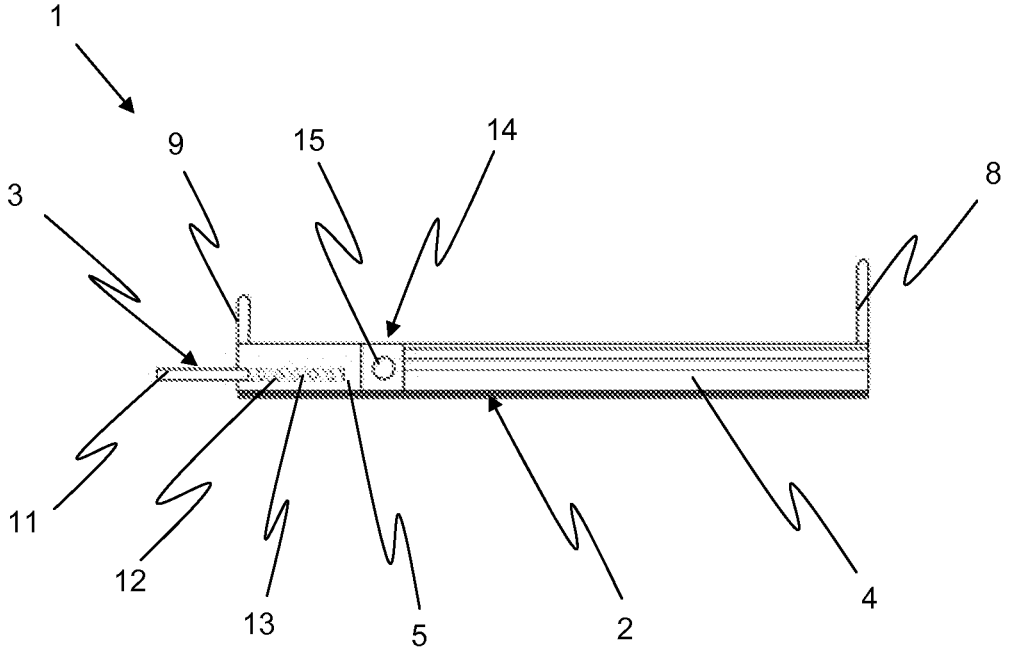
FIG. 2 is a side view of the shoe-measuring gadget.

The inner shoe length-measuring device has been arranged in the area of the toe stop 9 for determining the spatial length remaining between the longest toe of the foot (not shown here) and the inner shoe wall opposite this toe. The inner shoe length-measuring device 3 has a length measuring sensor 11. The length-measuring sensor 11 has been executed so it can be moved with regard to the toe stop 9 or the second structural part 5 in the longitudinal direction of the shoe-measuring gadget 1. To do this, the second structural part 5 has a recess 12, in which the length-measuring sensor 11 can be inserted at least partially (cf. FIG. 2). Furthermore, according to FIG. 2, the inner shoe length-measuring device 3 has a spring element 13 arranged in the recess 12 that outwardly loads the spring in the length-measuring sensor 11.

The shoe-measuring gadget 1 has a width-measuring device 14 so the widths of the foot positioned in the shoe-measuring gadget 1 can be measured in an area. In this embodiment, the width-measuring device 14 is firmly attached to the second structural part 5 of the foot length-measuring device 2 to form one single unit. The width-measuring device 14 is arranged between the first structural part 4 and the second structural part 5. Moreover, it is fastened to the front side of the second structural part 5 that faces the first structural part 4.

In an alternative embodiment not shown here, it is also conceivable for the width-measuring device 14 to be designed so it can be displaced in the longitudinal direction of the shoe-measuring gadget 1 with regard to the foot length-measuring device 2, especially with regard to the first structural part 4 and the second structural part 5. Thus, for example, the width-measuring device 14 could have a recess through which the guidance rail 6 would extend, so that the width-measuring device 14 could be executed so it can be displaced on it.

In accordance with FIG. 1, the width-measuring device 14 comprises a first and second width-measuring sensor 15, 16 designed to be moved in transversal direction of the shoe-measuring gadget 1. Compared to the shoe length-measuring device 2, the two width-measuring sensors 15, 16 have been executed to be moved in transversal direction of the shoe-measuring gadget 1.

In this embodiment, the width-measuring device 14 and the foot length-measuring device 2 have a locking element not recognizable in the drawings. The locking element has been designed so it can fix the respective measuring device in place in an adjusted position. To fix the two width-measuring devices 15, 16, the locking element has been executed as a detent so they can be moved outwards and inwards in discrete steps in transversal direction of the shoe-measuring gadget 1, in which case they are locked in place with a defined force. Alternatively or additionally, the width-measuring sensors can be spring-loaded outwards or inwards, so that they are pressed against an inner shoe wall intended for this purpose or against a foot flank intended for this purpose. To indicate the measured width (i.e. the distance between the two free ends of the two width-measuring sensors 15, 16), the width-measuring device 14 has a second gage 17. The second gage 17 has been executed as a display. Alternatively, however, the gage 17 could also be executed as an LED display, as is the case with the inner shoe length-measuring device 3.

Figure 4:
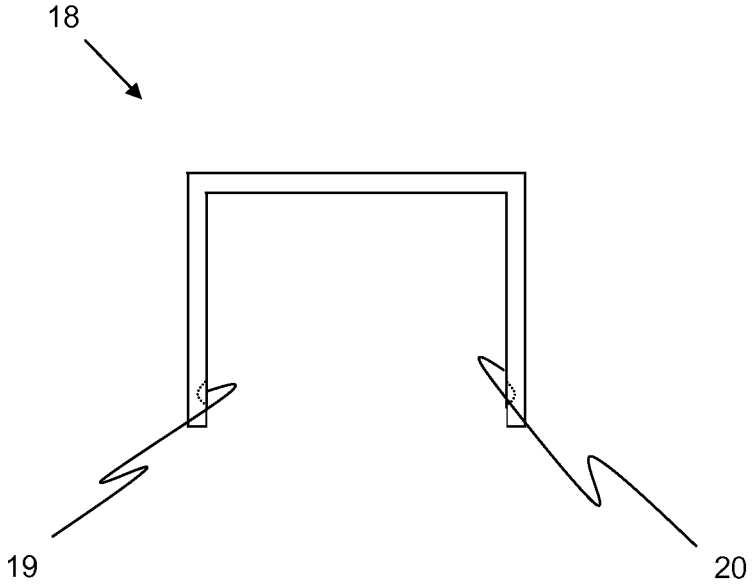
FIG. 4 is a clamping element.

In a first embodiment, the width-measuring device 14 has a clamping element 18 shown in FIG. 4. The clamping element 18 has a U-shaped design and has a first and second stop 19, 20. To determine the foot width in the foot positioned in the shoe-measuring gadget, the clamping element 18 can be attached in such a way in the area of the free ends of the two width-measuring sensors 15, 16, that the stops 19, 20 are pressed against the foot flanks of the foot with a defined force. To accomplish this, the clamping element 18 has been designed in a flexible and/or elastic way. In an alternative embodiment not shown here, the clamping element 18 has also an adjustment device for adjusting its opening width. As a result of this, the clamping element 18 can be adjusted to feet having different widths. Preferably, in this case, the clamping element 18 has been stiffly designed and/or has a locking element, particularly a locking screw, with which the adjusted width of the clamping element 18 can be engaged and disengaged and locked in place.

Figure 5:
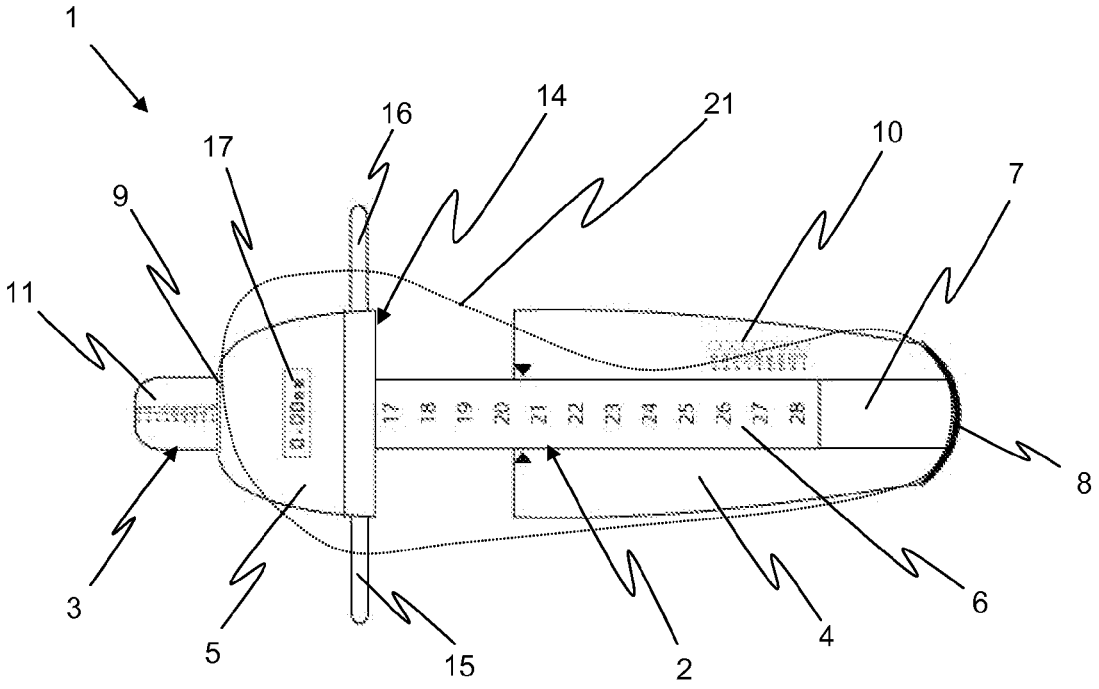
FIG. 5 is a top view of the shoe-measuring gadget in which the shoe has been positioned in the shoe-measuring gadget for determining the length of the foot.

To determine the accuracy of fit of a shoe, a foot 21 is first of all positioned in the shoe-measuring gadget 1 as shown in FIG. 5. Here, the heel stop 8 rests initially on the heel of the foot. Then, the second structural part 5 of the foot length-measuring device 2 is moved in such a way with regard to the first structural part 4 that the big toe of the foot 21 comes to rest on the toe stop 9. In this case, the two structural parts 4 are guided in the longitudinal direction of the shoe-measuring gadget 1 with the help of the guiding rail 6 being guided by the guiding groove 7. The measured foot length is preferably fixed with the locking element (not recognizable in the drawings), as a result of which the two structural parts 4, 5 are locked in place with respect to one another.

Figure 6:
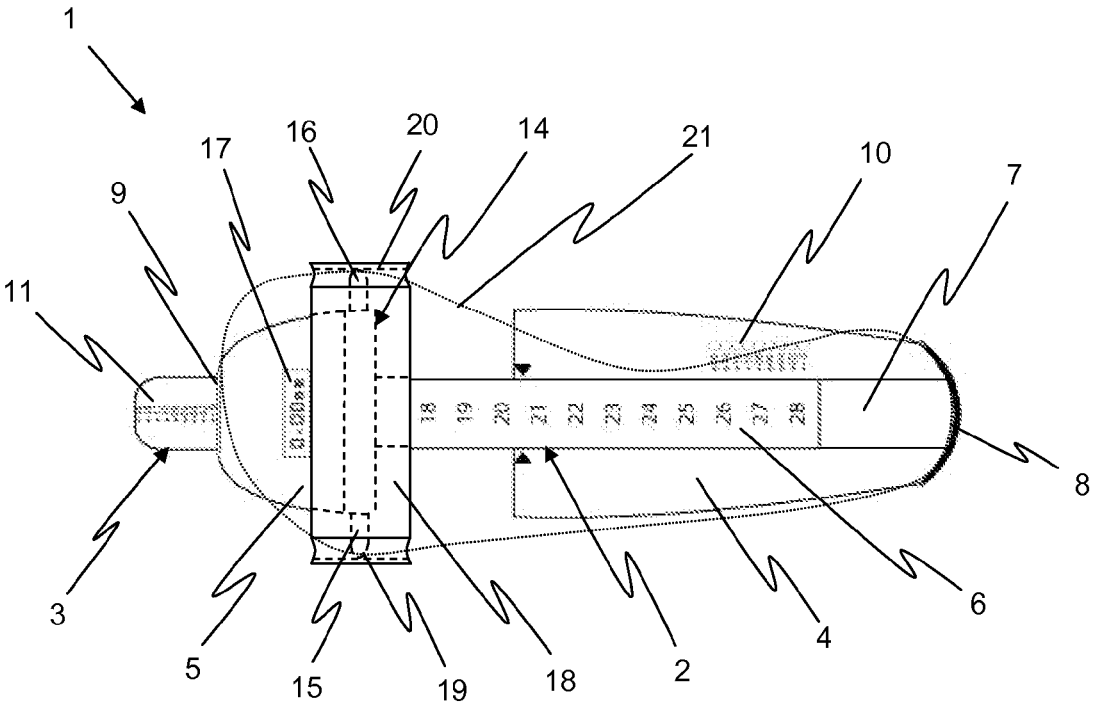
FIG. 6 is a top view of the shoe-measuring gadget with the clamping element for determining foot width arranged on the width-measuring sensors.

According to FIG. 5, the two width-measuring sensors 15, 16 are initially moved further outwards than the widest spot of the foot 21. If the width-measuring device 14 is movably designed in the longitudinal direction of the shoe-measuring gadget 1 compared to the foot length-measuring device, it can be moved in longitudinal direction to the widest spot of the foot 21. In another step according to FIG. 6, to determine the foot width of the foot 21 positioned in the shoe-measuring gadget 1, the clamping element 18 of the width-measuring device 14 is placed over the foot 21 on the free ends of the two width-measuring sensors 15, 16 arranged coaxially towards one another. To do this, the flexibly designed clamping element 18 is first of all bent up so that it presses the two width-measuring sensors 15, 16 inwards when placed on their free ends. According to FIG. 6, the two stops 19, 20 of the clamping element 18 come to rest on the widest spot of the foot 21, on its inner/outer flank. The foot width determined in this way is indicated by means of the second gage 17, so the user can read it.

Figure 7:
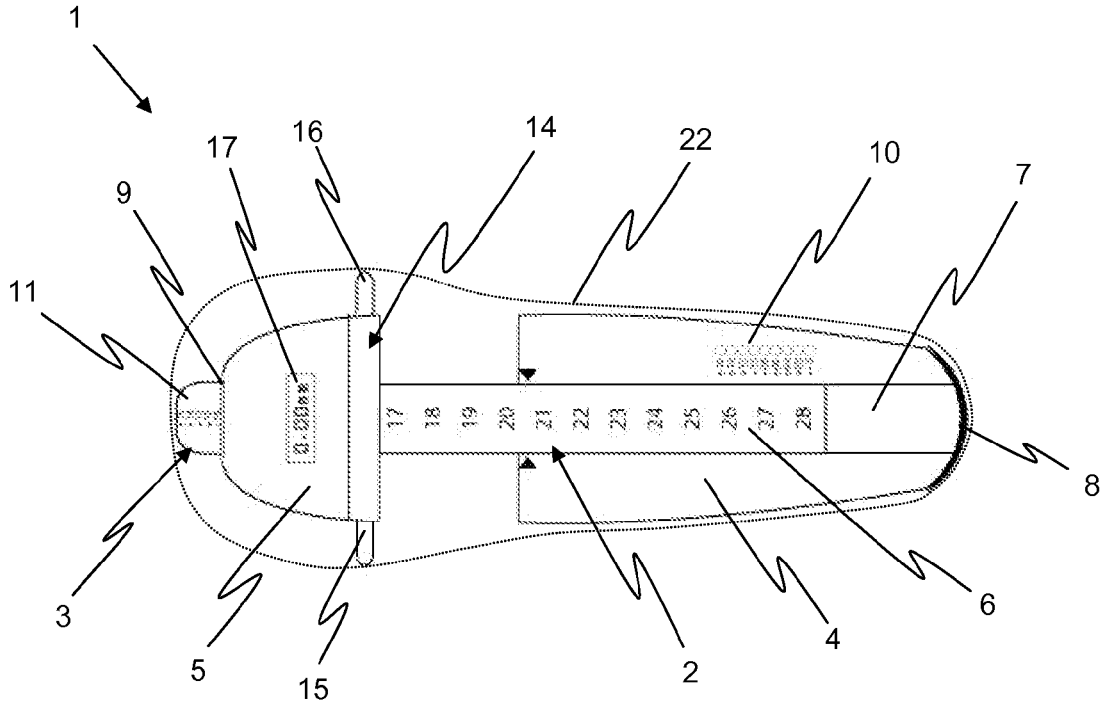
FIG. 7 is a top view of the shoe-measuring gadget in a state in which a shoe has been inserted.

Afterwards, according to FIG. 7, the shoe-measuring gadget 1 is inserted in a shoe 22 intended for this. Since the foot length-measuring device 2 is locked in place, the distance between the first and second structural part 4, 5 is constant. As soon as the free end of the length-measuring sensor 11 makes contact with the inner shoe wall intended for this, the length-measuring sensor 11 is pressed into the recess 12 when the shoe-measuring gadget 1 is inserted even more. Owing to the fact that the length-measuring sensor 11 is outwardly spring-loaded by means of the spring element 13, it can be ensured that there will not be any free space between the free end of the length-measuring sensor 11 and the inner shoe wall intended for this. As a result of this, a very accurate measurement can be ensured. The accuracy of fit of the shoe with regard to the individual foot length measurements determined and compared is indicated by the first gage 10.

To determine inner shoe width, the two width-measuring sensors 15, 16 are initially moved outwards before insertion into the shoe 22. Alternatively, the two width-measuring sensors 15, 16 can also be outwardly spring-loaded. In both cases, the free ends of the width-measuring sensors 15, 16 cling to the respective opposite inner shoe wall when they are inserted into the shoe 22. The shoe width determined is indicated by the second gage 17. After the shoe-measuring gadget 1 is taken out of the shoe 22 intended for this purpose, a user can read the inner shoe width measured on the second gage 17 and estimate the accuracy of fit by doing a mental calculation with the previously determined foot width.

Alternatively, the width-measuring device 14 can also be executed in such a way in an embodiment not shown here, however, that the remaining spatial width between the foot and the respective opposite inner shoe wall is determined and indicated automatically by the width-measuring device 14. To accomplish this, and as far as the operating principle is concerned, the width-measuring device 14 can be executed, for example, like the foot length- and inner shoe length-measuring device coupled with one another.

Figure 8:
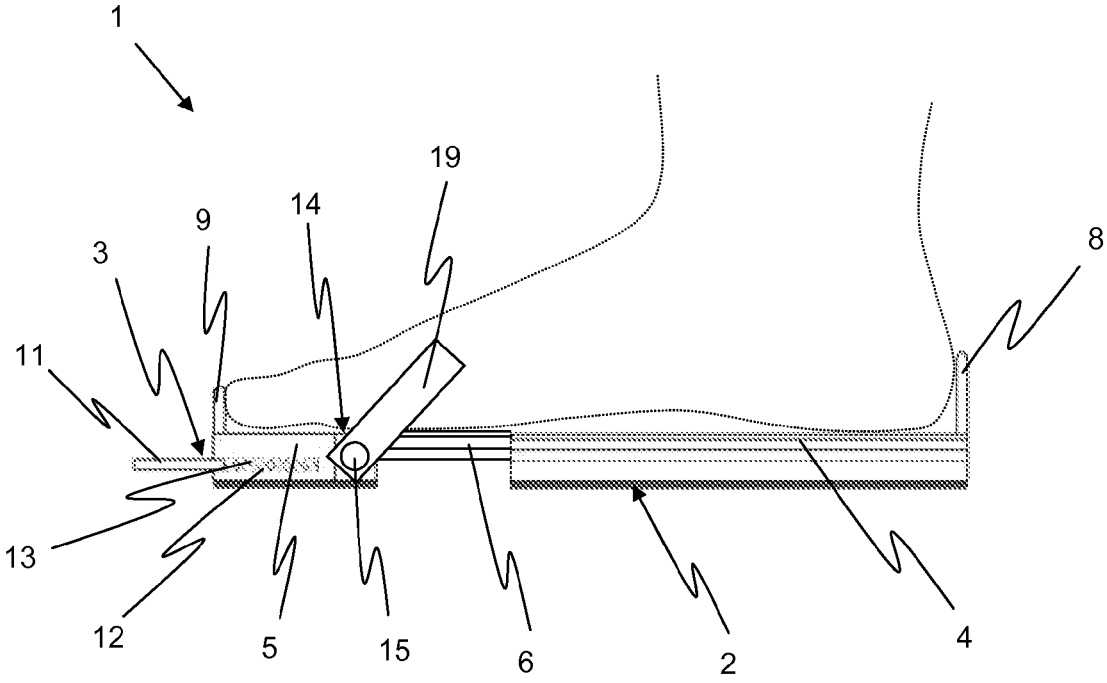
FIG. 8 is an alternative embodiment of the width-measuring device.

FIG. 8 shows an alternative embodiment of the width-measuring device 14 in which the stops 19 are movably connected to the corresponding free end of the width-measuring sensor 15. With regard to the free ends of the corresponding width-measuring sensor 15, the stops 19 are movably designed in such a way that they can be changed from a first, flat position close to the foot sole to a second, raised position close to the foot flank, as shown in FIG. 8 for determining the width of the foot. In this embodiment, the stops 19 are executed so they can be rotated with respect to the free end of the corresponding width-measuring sensor 15.

This invention is not limited to the embodiments shown and explained. Variations within the framework of the patent claims are just as possible as a combination of the characteristics, even if these are shown and explained in different embodiments.

The invention claimed is:

1. A shoe-measuring gadget to determine accuracy of fit of shoes for a wearer of the shoes, the gadget comprising:

a foot length measuring device that determines length of a foot positioned in the gadget;

an inner shoe length measuring device that determines spatial length remaining between the wearer's longest toe and a shoe wall opposite the toe when the gadget is placed within a shoe intended to be worn by the wearer after the length of the wearer's foot is taken by the foot length measuring device;

a width measuring device that determines width of he wearer's foot positioned in the gadget;

the width measuring device further configured to determine inner shoe width when the gadget is placed within the shoe; and a calculator device that determines spatial width remaining between the wearer's foot and inner shoe walls from the determined width of the wearer's foot and inner shoe width.

2. The shoe-measuring gadget as in claim 1, wherein the width measuring device comprises at least one width sensor movable in a transverse direction relative to a longitudinal aspect of the gadget, and the inner shoe length measuring device comprises a length sensor movable in the longitudinal aspect of the gadget.

3. The shoe measuring gadget as in claim 2, wherein the width sensor is spring loaded towards the direction of the inner shoe wall or towards the direction of the wearer's foot.

4. The shoe measuring gadget as in claim 3, wherein the length sensor is spring loaded towards the direction of the inner shoe wall or towards the direction of the wearer's foot.

5. The shoe measuring gadget as in claim 4, wherein the width measuring device and length measuring device comprise respective detachable locking elements that hold the width sensor and length sensor in a measured position.

6. The shoe measuring gadget as in claim 5, wherein the locking elements comprise detents so that position of the width sensor and length sensor is adjustable in discrete lengths and held with a defined force determined by the detents.

7. The shoe measuring gadget as in claim 2, wherein the width sensor comprises a stop device that engages against the wearer's foot when determining width of the wear's foot, the stop device removable from the gadget when the gadget is inserted into the shoe so that the width sensor can contact the inner wall of the shoe to determine width of the shoe.

8. The shoe measuring gadget as in claim 1, further comprising a toe stop and an insertion aid extending longitudinally towards the toe stop to aid insertion of the gadget into the shoe, and a heel stop and a removal aid extending longitudinally towards the heel stop to aid removal of the gadget from the shoe.

9. The shoe measuring gadget as in claim 8, wherein the toe stop and the heel stop are detachable from the gadget.

10. The shoe measuring gadget as in claim 1, wherein the width measuring device is arranged on the gadget so as to measure the ball area of the wearer's foot or ball area of the shoe when the gadget is placed in the shoe to be worn by the wearer.

11. The shoe measuring gadget as in claim 1, wherein the width measuring device comprises oppositely disposed and coaxial width sensors, the width sensors spring loaded in opposite coaxial directions.

12. The shoe measuring gadget as in claim 11, further comprising a U-shaped clamping element attachable to the gadget such that arms of the U-shaped clamping element engage against sides of the wearer's foot, the arms defining stops against which free ends of the width sensors engage to determine the width of the wearer's foot.

13. The shoe measuring gadget as in claim 12, wherein spacing between the arms is adjustable and lockable.

14. The shoe measuring gadget as in claim 12, wherein the inner shoe length measuring device further comprises a length sensor movable in the longitudinal aspect of the gadget, the calculator device determining width of the wearer's foot after the width sensors are engaged with the stops for a first predetermined period of time and the length sensor is engaged with the wearer's foot for a second predetermined period of time.

15. The shoe measuring gadget as in claim 14, further comprising an actuator button that is depressed to generate the width calculation after the first and second predetermined periods of time.

16. The shoe measuring gadget as in claim 14, wherein the calculator device further comprises a display that indicates the remaining spatial width in the shoe.

17. The shoe measuring gadget as in claim 12, wherein the inner shoe length measuring device further comprises a length sensor movable in the longitudinal aspect of the gadget, the calculator device determining width of the shoe when the gadget is placed within the shoe after the width sensors are engaged with the sides of the shoe for a first predetermined period of time and the length sensor is engaged with an end of the shoe for a second predetermined period of time.

* * * * *